United States Patent [19]

Knürr

[11] Patent Number: 5,040,268

[45] Date of Patent: Aug. 20, 1991

[54] CASE HINGE

[75] Inventor: Hans Knürr, Kirchheim, Fed. Rep. of Germany

[73] Assignee: Knurr-Mechanik Fur Die Elektronik Aktiengesellschaft, Munich, Fed. Rep. of Germany

[21] Appl. No.: 414,286

[22] Filed: Sep. 29, 1989

[30] Foreign Application Priority Data

Oct. 6, 1988 [DE] Fed. Rep. of Germany ..... 3834053

[51] Int. Cl.[5] ..... E05D 1/06

[52] U.S. Cl. ..... 16/261; 16/285; 16/351

[58] Field of Search ..... 16/229, 254, 350, 351, 16/317, 297, 377, 261, 285, 380

[56] References Cited

U.S. PATENT DOCUMENTS

| | | | |
|---|---|---|---|
| 825,050 | 7/1906 | Hammer | 16/351 |
| 1,076,568 | 10/1913 | Furuya | 16/297 |
| 1,294,044 | 2/1919 | Buckwalter et al. | 16/351 |
| 1,621,047 | 3/1927 | Young | 16/351 |
| 2,186,789 | 1/1940 | Rosenberg | 16/229 |
| 3,373.529 | 3/1968 | Ingham | 16/71 |
| 3,671,998 | 6/1972 | Ruiz | 16/229 |
| 4,620,392 | 11/1986 | Kerpers et al. | 16/229 |

*Primary Examiner*—Kurt Rowan
*Assistant Examiner*—J. Miner
*Attorney, Agent, or Firm*—Fleit, Jacobson, Cohn, Price, Holman & Stern

[57] ABSTRACT

Two parts of a case hinge are detachably interconnected, i.e. the hinge pin of one part and the hollow cylinder of the other part can be disengaged by axial displacement. Moreover, the hinge pin is rotatably and axially displaceably mounted on the associated hinge part and is pretensioned in an axially resilient manner. It is provided on its free end with a rotation preventer, which engages in non-rotary and axially detachable manner with the other hinge part. On opening and closing the case the hinge pin consequently necessarily performs a rotary movement. In its bearing-side portion, the hinge pin is provided with a radial stop pin, which locks in a bearing-side indentation under a predetermined angle as a result of spring tension and consequently detachably secures the two hinge parts under a predetermined opening angle.

3 Claims, 1 Drawing Sheet

CASE HINGE

BACKGROUND OF THE INVENTION

The invention relates to a case hinge comprising a hinge pin and a hollow cylinder for the detachable connection of a case top and a case bottom. The pin is provided with an all-round groove for forming a locking edge and the hollow cylinder is provided with a resilient detent, which is rotatably and axially detachably engaged with the groove when the pin is located in the hollow cylinder. Such hinges are frequently used on tool or instrument cases. As both the case top and case bottom can receive the case content, it is advantageous if both case parts can be separated from one another on inserting the tools or instruments. However, in order to prevent an unintentional unhinging, the hinge is secured with the aid of a resilient locking element. Only when the spring tension is overcome by an operator is it possible to separate the two hinge parts.

Particularly in the case of cases, which are intended to receive measuring and indicating instruments or computers, it is also desirable for the case top to assume a predetermined swivel angle to the case bottom in the swung-up condition. For example, the case bottom can contain control elements and the case top indicating or display elements, which the operator should have in his field of vision with minimum restriction or impediment.

For this purpose it has hitherto been necessary to fit supports, strips or chains for preventing the swinging of the case top over and beyond the predetermined swivel angle. However, these measures lead to the disadvantage that said parts also have to be housed in the case interior. However, as both the case dimensions and the equipment to be housed therein are in many cases standardized, necessarily storage space is lost. It is also unavoidable that the case walls have to be perforated for fixing said support means, which leads to additional sealing problems. In addition, such components make it impossible or at least very difficult to separate the two case parts.

SUMMARY OF THE INVENTION

The object of the invention is to provide a case hinge of the aforementioned type enabling the case top to be held in a predetermined swivel position, without it being necessary to use any impeding means.

This object is achieved by the characterizing part of the main claim. Further developments of the invention appear in the subclaims.

The invention has the advantage that the case top and the case bottom can be separated from one another as desired, or can be secured in predetermined angular positions. This greatly increases the comfort of the user. As the swivel locking means is integrated into the hinge, the case interior can be fully utilized and no dead spaces are formed. In addition, no fastening openings are required, so that the case is kept tight.

Another advantage is that in simple manner several swivel positions can be obtained. In addition, the hinge can be manufactured and fitted in a simple manner.

The invention is described in greater detail hereinafter relative to an embodiment and the attached drawings.

DESCRIPTION OF THE PREFERRED EMBODIMENT

Figure 1:
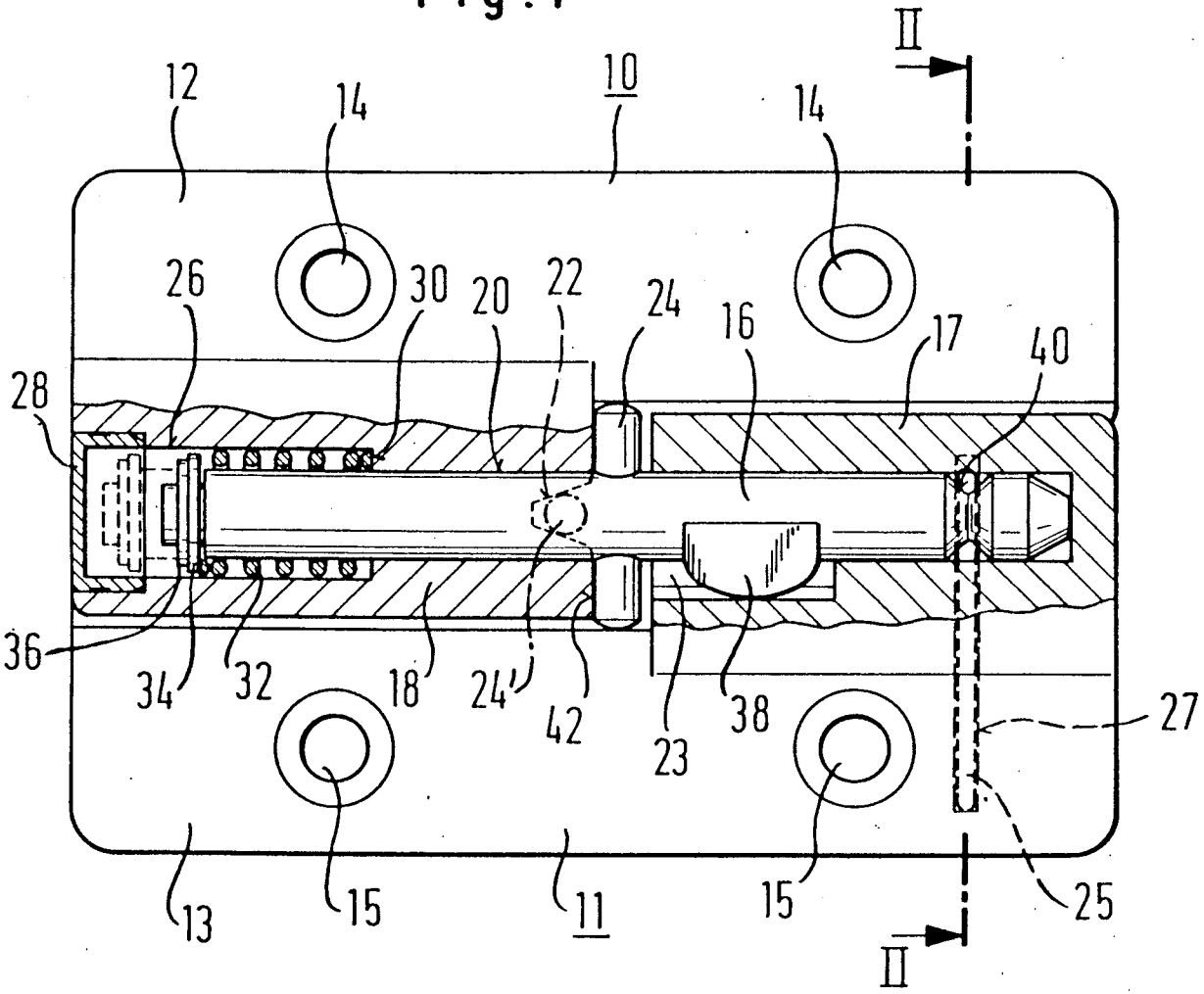
FIG. 1 diagrammatically shows a part sectional plan view of a hinge.

The example of a hinge according to FIG. 1 comprises a pin-side hinge part 10 and a hollow cylinder-side hinge part 11. For fixing to a case top or bottom (not shown), they in each case have a fastening lug 12 or 13, which are in each case provided with two bores 14 or 15. Not shown screws or rivets can be inserted through said bores 14,15 at right angles to the drawing plane, in order to fix the hinge part to the particular case shells. FIG. 1 shows the two hinge parts 10,11 in the joined state, i.e. a hinge pin 16 on the first fastening lug 12 is inserted in a hollow cylinder 17 on the second fastening lug 13 and is resiliently locked therein. Moreover, the two fastening lugs 12,13 are identically oriented in the drawing plane.

The pin 16 is held in a hollow cylindrical base 18, which takes up roughly half the longitudinal side of the first fastening lug and is co-axially located with respect to the hollow cylinder 17. The hinge pin 16 is mounted in rotary and longitudinally displaceable manner in a through straight bore 20. In the represented example, the latter is provided on the side facing the free end of the hinge pin 16 with a radially directed indentation 22 for receiving a stop pin 24. The latter is transversely inserted in hinge pin 16 and projects on either side thereof. In the represented example indentation 22 is at right angles to the drawing plane. However, it is also easily possible to arrange the indentation under a different angle. There can naturally also be several such indentations, so that the stop pin 24 can engage with the particular indentation 22 in different angular positions. The drawing shows the stop pin 24 in a position in the drawing plane indicated by a continuous line and where it is supported on the end face 42 of base 18. The dot-dash line shows the stop pin 24' engaged with indentation 22. It is clear that on passing between these two positions, the stop pin 24 necessarily performs an axial movement.

The straight bore 20 is provided on the side facing away from the free end of hinge pin 16 with a blind hole-like cylindrical extension 26, which is frontally closed for optical reasons by a cover 28. On the shoulder 30 of the extension is supported a helical compression spring 32, which surrounds the cylindrical portion extending into extension 26 and produces on hinge pin 16 a pretension directed outwards on cover 28. For this purpose it is supported on a disk 34, which is fixed by means of a securing disk 36 to the front of the hinge pin 16. In the case of a corresponding angular position, the pretension ensures that the stop pin 24 is reliably held in the indentation 22. On the basis of these constructional details, hinge pin 16 can easily be fitted in base 18.

The free end of hinge pin 16 is provided with a radially projecting rotation preventer 38 constructed as a tongue and which engages in non-rotary manner in an axially open slit 23 in the hollow cylinder 17 of the other hinge part 11, but is axially detacbable. In the case of pivoting of the two hinge parts 10,11, this rotation preventer leads to the hinge pin 16 performing a rotary movement. As soon as the swivel angle given by the indentation 22 is reached, the stop pin 24 locks in, so that the hinge or the associated case shell is reliably held in this angular position. By a further pivoting, this locked position can be cancelled out again, in that the stop pin 24 is turned further over the bevelled sides of the indentation 22.

The hollow cylinder-side hinge part 11 is detachably fastened against axial displacement on the free end of hinge pin 16. For this purpose hinge pin 16 is provided with a circular groove 40, in which engages under pre-tension a hinge part-side stop spring 25. This axial fastening can be removed by overcoming the pretension of stop spring 25.

Figure 2:
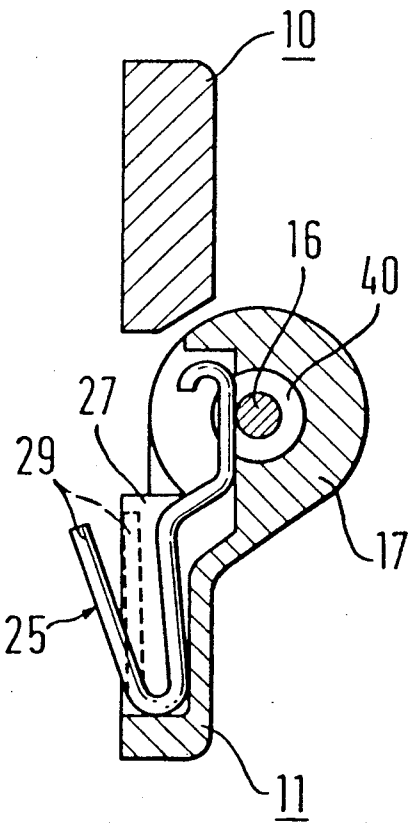
FIG. 2 shows a cross-section through the hinge along section line II—II in FIG. 1.

FIG. 2 shows that the stop spring 25 is arranged in an outwardly open slit 27 in hinge part 11. Thus, for as long as hinge part 11 has not yet been fitted to a substrate, a leg 29 of stop spring 25 projects from the slit. This state is represented by a continuous line. After fitting, the leg 29 is forced by the substrate completely into slit 27, which is shown by the broken line. The stop spring 25 is pretensioned in this position.

What we claim is:

1. A hinge structure comprising first and second hinge plates, first and second hinge cylinders on the respective plates, a hinge pin received in and coaxially connecting the respective cylinders, the hinge pin being axially movable and rotatably mounted with respect to the first cylinder, the hinge pin being axially movable and non-rotatably mounted with respect to the second cylinder, a transverse stop pin carried by the hinge pin between the cylinders, a spring in the first cylinder axially urging the hinge pin to engage against an end face of the first cylinder which is adjacent the second cylinder, and at least one recess in said end face of the first cylinder for receiving the stop pin and releasably arresting the hinge plates in a predetermined angular position of the plates, the stop pin being removable from said recess by relative rotation of the plates.

2. A hinge structure as defined in claim 1 wherein the first cylinder includes a recess extending from one end opposite said end face, said spring comprising a helical tension spring received in said recess around the hinge pin, the spring being compressed between a shoulder defining a base portion of the recess and a disc mounted on the hinge pin.

3. A hinge structure as defined in claim 1 wherein the hinge pin includes a radial tongue received in an axial slit in the second cylinder for axially movably and non-rotatably mounting the hinge pin with respect to the second cylinder.

* * * * *